US009908651B2

(12) United States Patent
Ehmer et al.

(10) Patent No.: US 9,908,651 B2
(45) Date of Patent: Mar. 6, 2018

(54) METHOD AND DEVICE FOR TREATING PACKAGES

(71) Applicant: KHS GmbH, Dortmund (DE)

(72) Inventors: Wilfried Ehmer, Dortmund (DE); Martin Schach, Bochum (DE)

(73) Assignee: KHS GmbH, Dortmund (DE)

( * ) Notice: Subject to any disclaimer, the term of this patent is extended or adjusted under 35 U.S.C. 154(b) by 697 days.

(21) Appl. No.: 14/387,345

(22) PCT Filed: Mar. 7, 2013

(86) PCT No.: PCT/EP2013/000662
§ 371 (c)(1),
(2) Date: Sep. 23, 2014

(87) PCT Pub. No.: WO2013/143647
PCT Pub. Date: Oct. 3, 2013

(65) Prior Publication Data

US 2015/0113918 A1 Apr. 30, 2015

(30) Foreign Application Priority Data

Mar. 26, 2012 (DE) ..... 10 2012 005 926

(51) Int. Cl.

| | |
|---|---|
| ***B65B 31/04*** | (2006.01) |
| ***B41J 3/407*** | (2006.01) |
| ***B65B 55/10*** | (2006.01) |
| ***B41J 11/00*** | (2006.01) |
| ***B65B 51/00*** | (2006.01) |
| ***B65B 55/18*** | (2006.01) |
| ***B65B 61/26*** | (2006.01) |

(52) U.S. Cl.
CPC ..... *B65B 31/04* (2013.01); *B41J 3/4073* (2013.01); *B41J 11/0015* (2013.01); *B65B 51/00* (2013.01); *B65B 55/10* (2013.01); *B65B 55/18* (2013.01); *B65B 61/26* (2013.01)

(58) Field of Classification Search
CPC ..... B41J 3/543; B41J 3/4073; B41J 11/002; B41J 11/0015; B65B 31/04–31/06; B65B 51/00; B65B 55/10; B65B 61/26; B65G 2201/0244; B65G 2201/0247; B65G 2201/0261
USPC ..... 53/111 R, 111 RC, 128.1, 131.2, 131.4, 53/403, 408, 411; 101/35–37
See application file for complete search history.

(56) References Cited

U.S. PATENT DOCUMENTS 5,163,487 A * 11/1992 Clusserath ..... B65B 55/10 141/39
2006/0144261 A1* 7/2006 Uptergrove ..... B41J 3/4073 101/35

(Continued)

FOREIGN PATENT DOCUMENTS

DE 10 2008 049241 4/2010
DE 10 2009 011054 9/2010

(Continued)

*Primary Examiner* — Hemant M Desai
*Assistant Examiner* — Valentin Neacsu
(74) *Attorney, Agent, or Firm* — Occhiuti & Rohlicek LLP

(57) ABSTRACT

A method for treating packages includes ink jet printing designs on packages, arranging packages on a treatment position of a package transport path, and at least intermittently charging the packages, during printing thereon, with a gaseous sterilizing agent.

19 Claims, 17 Drawing Sheets

(56) References Cited

U.S. PATENT DOCUMENTS

| | | | | |
|---|---|---|---|---|
| 2007/0157559 | A1* | 7/2007 | Till | B41J 2/06 53/411 |
| 2010/0192517 | A1* | 8/2010 | Schach | B41J 2/0057 53/411 |
| 2010/0205908 | A1* | 8/2010 | Sangi | A61L 2/208 53/426 |
| 2011/0179959 | A1* | 7/2011 | Gerigk | B41J 3/4073 101/40 |
| 2011/0232514 | A1* | 9/2011 | Putzer | B41J 3/4073 101/36 |
| 2012/0011807 | A1* | 1/2012 | Preckel | B41J 3/4073 53/167 |
| 2012/0017783 | A1* | 1/2012 | Uptergrove | B41J 3/4073 101/38.1 |
| 2013/0160405 | A1* | 6/2013 | Preckel | B41J 3/4073 53/452 |

FOREIGN PATENT DOCUMENTS

| | | |
|---|---|---|
| DE | 10 2009 043497 | 3/2011 |
| DE | 10 2010 044244 | 3/2012 |
| EP | 1 050 344 | 11/2000 |
| JP | S61242667 | 10/1986 |
| JP | 2000218214 | 8/2000 |
| JP | 2001171222 | 6/2001 |
| JP | 2006181368 | 7/2006 |
| JP | 2010515628 | 5/2010 |
| JP | 2011125861 | 6/2011 |

* cited by examiner

METHOD AND DEVICE FOR TREATING PACKAGES

RELATED APPLICATIONS

This application is the U.S. national stage of PCT application PCT/EP2013/000662, filed on Mar. 7, 2013, which claims the benefit of the Mar. 26, 2012 priority date of German application 10 2012 005 926.4. the contents of which are herein incorporated by reference.

FIELD OF INVENTION

The invention relates to a method and apparatus for treating packages that are to have a design printed thereon.

BACKGROUND

Many versions of devices for treating packages are known. Included in the known devices are those in which the packages, during the entire transport from a packages inlet to a package outlet, are held on one and the same holding-and-centering unit, or puck. The holding-and-centering units only release the packages at a package outlet. After dropping off a package, each holding-and-centering unit is returned on a puck return transport path to a package inlet.

SUMMARY

The invention provides a method with which, when applying the design features, a treatment of the packages with a medium in the form of gas and/or vapor, preferably with a rinsing and/or sterilizing medium in the form of gas and/or vapor, also takes place at the same time.

Embodiments of the invention include those that, at the treatment positions, have a height-adjustable slide, i.e. one that is adjustable in the direction of the machine axis, for holding the packages or the holding-and-centering elements. Also among the embodiments are those in which primary parts of holding-and-centering units are pucks and secondary parts are adapted to different types, shapes and/or sizes of the packages.

In other embodiments, holding-and-centering units, preferably their secondary parts, are designed with an RFID identifier.

In other embodiments, a puck-transport path for returning the holding-and-centering units, which can be designed as pucks, at least from a package outlet to a package inlet. In these embodiments, the transport path is partially formed by transport-and-treatment elements that are also part of a package transport route.

In other embodiments, between the treatment positions, positions or receptacles for receiving the holding-and-centering units are formed. These can be pucks. In these embodiments, these receptacles are part of the puck-transport path.

In other embodiments, holding-and-centering elements each have at least one holding-and-centering unit for passively holding packages, for example for holding the packages by spring force.

Other embodiments have holding-and-centering units that are designed with means for covering the packages in a region of a package mouth and/or in a region of a local thread for a screw closure. For example, the units may have a recess for receiving the mouth region of a respective single package.

In other embodiments, holding-and-centering units are held passively at an associated printing segment, i.e. a corresponding holding force is applied passively to a primary part of a holding-and-centering unit, and holding-and-centering units are actively removed from the printing segments.

In other embodiments, each printing segment has at least control electronics at least for controlling the print head.

In yet other embodiments, each printing segment has at least one actuating drive for adjusting the at least one print head.

Also among the embodiments are those that, at a printing segment or at a housing thereof, have a coupling unit for an electric connection and for a fluid connection of the printing segment with a machine-end or rotor-end coupling unit.

Other embodiments have mechanical centering-and-holding elements provided at a printing segment or at a housing thereof.

In other embodiments, dummy segments, which correspond to the printing segments in shape and size but do not form a treatment position, are provided for arrangement between printing segments.

In yet other embodiments, a package transport path is formed by a plurality of transport-and-treatment elements with the treatment positions that, in a direction of transport, are consecutive and each can be driven in rotation about a vertical machine axis.

In some embodiments, at a primary part and/or at the secondary part of a holding-and-centering unit, at least one coding is provided. The coding interacts with at least one incremental sensor at a respective working position.

In other embodiments, a secondary part of a holding-and-centering unit forms a rotor of a rotary drive for controlled alignment and/or rotation of respective single packages. For this purpose, it is preferable to have a permanent magnet arrangement that interacts with a stator of the rotary drive or with an electromagnet arrangement forming such a stator.

In other embodiments, each printing segment has an electromagnet arrangement forming a stator of a rotary drive for the holding-and-centering units and/or the at least one incremental sensor for capturing at least one coding of a holding-and-centering unit.

Yet other embodiments include means for holding, preferably for the controlled holding and/or releasing of holding-and-centering units, Also included within the scope of the invention are embodiments with combinations of the foregoing features.

In another aspect, the invention features a method for treating packages. Such a method includes applying designs by inkjet printing on the packages. The method further includes arranging packages on a treatment position of a package transport path, and intermittently, charging the packages, during printing thereon, with a gaseous sterilizing agent.

In some practices, intermittently charging includes intermittently charging with a pressurized gaseous sterilizing agent.

In yet other practices, intermittently charging includes exposure to a sterilizing agent comprising one of $H_2O_2$ and ozone, and exposure to a gaseous activating and drying component.

Additional practices include those in which the method further comprises, after intermittently charging, closing the packages at least towards the environment in which treatment occurs at least during a part of a total duration of treatment of the packages.

Yet other practices include holding the packages in corresponding holding-and-centering units. In these practices, charging takes place via the holding-and-centering units. Among these practices are those in which holding comprises holding the packages in the same corresponding holding-and-centering units throughout treatment thereof, in which case the method further includes moving the packages past at least two consecutive treatment positions in a transport direction of the transport path, and, at the at least two treatment positions, simultaneously charging the packages with the sterilizing agent. Also included within these practices are those in which holding comprises holding a package in the same corresponding holding-and-centering unit throughout treatment thereof. In these practices, the method further includes moving the packages past at least two consecutive treatment positions in a transport direction of the transport path, and causing the holding-and-centering units to hold the packages in a closed position during transfer thereof, by the holding-and-centering elements, from a transport-and-treatment element to a transport element that follows in the transport direction.

Additional practices include, at the end of treating a package, sucking the sterilizing agent at least from a headspace of the package.

In another aspect, the invention features an apparatus for printing designs on packages. Such an apparatus includes a package inlet, a package outlet, a package transport path, a transport-and-treatment element, and treatment positions. The package transport path extends between the package inlet and the package outlet so that packages move along the package transport path along a transport direction from the package inlet to the package outlet. The package transport path is formed at least in part by the transport-and-treatment element. The transport-and-treatment element is drivable to rotate. Each of the treatment positions is configured either to hold a package during treatment thereof, to center a package during treatment thereof, or to cause controlled movement of a package during treatment thereof. Printing of the design on a package takes place at a treatment position associated with the package. Each of the treatment positions is further configured to charge an interior of a package associated with the treatment position with a sterilizing medium.

Some embodiments also include holding-and-centering units. Each holding-and-centering unit includes a puck that is configured to pick up a package at the package inlet and transport the package to the package outlet. The puck releases the package only at the package outlet. Additionally, the puck is configured to introduce the sterilizing agent.

Among these embodiments are those in which each of the holding-and-centering units includes a first gas path for introducing the sterilizing agent into a package, a second gas path for discharging the sterilizing agent from the package, and a connecting element via which the gas paths are connected to device-internal fluid connections for supplying and removing the sterilizing agent.

Also among these embodiments are those in which each of the holding-and-centering units is configured for closing off an interior of a package associated with the holding-and-centering unit.

In others of these embodiments, there is also a puck-transport path via which the pucks are returned from the package outlet to the package inlet. In these embodiments, a facility or station is disposed on the puck-transport path. The facility or station is either a cleaner for cleaning holding-and-centering units, or a sterilizer for sterilizing holding-and-centering units.

In some embodiments, holding-and-centering units each comprise a mouth opening against which a package mouth of a package being treated abuts during treatment thereof. In these embodiments, the apparatus also has rinsing caps for closing the openings during CIP cleaning and sterilization of the holding-and-centering units.

In some embodiments, each holding-and-centering unit includes a primary part and a secondary part. The primary part is held, during treatment, at a treatment position. The secondary part is configured to hold a package. At or in the primary part, the secondary part is supported to be rotatable about an axis of the holding-and-centering unit.

In other embodiments, there is, at each treatment position, a printing segment including a print head for printing on a package. Each printing segment forms a fully functional assembly unit. The printing segments are arranged at a rotor that can be driven to rotate about a machine axis.

In other embodiments, the print head is an inkjet print head.

In yet other embodiments, the treatment position further includes a facility for either drying and curing ink by either heat, UV radiation, or microwave radiation.

In some embodiments, the apparatus defines a vertical machine axis about which the transport-and-treatment element is driven to rotate. The print heads are then configured to be one of movable along the machine axis and pivotable about the machine axis.

Other embodiments include, at each treatment position, a printing-ink control module configured to control or regulate either temperature of ink supplied to the print head or volume rate of flow of ink supplied to the print head.

In yet other embodiments, a pressure compensation tank for use in supplying ink to the print head under control of the printing-ink control module.

Other embodiments include a pump for supplying ink to the print head under control of the printing-ink control module and discharging excess ink from the print head.

In yet other embodiments, a printing segment has a connection for either supplying or discharging the sterilizing agent.

As used herein, "packages" means packages or containers that are normally used in the food sector and, especially, also in the beverage sector, in particular, containers such as bottles, cans, and soft packages, for example those made from carton and/or plastic foil and/or metal foil.

As used herein, the term "transport puck" or "puck" means a holding, centering, and aligning unit for packages on which a single package, which is held from the package inlet to the package outlet, is moved through a package transport path of the transport system and which, hereby, preferably also effects a controlled orientation of the respective single packages for its treatment.

As used herein, "transport elements that, in a direction of transport, are consecutive" means transport elements or transport and treatment elements that are designed and arranged such that they receive, in transfer areas, the pucks from an adjacent transport element preceding in a transport direction, and after holding them, pass those pucks to a transport element that follows in the transport direction.

As used herein, "essentially," "substantially" or "about" mean deviations from the particular exact value by +/−10%, preferably by +/−5%, and/or deviations in the form of changes that are insignificant to the function.

As used herein, "head space" means that partial space of a package interior or container interior that is directly under the package's opening or the container's opening.

Further developments, advantages and possible applications of the invention can also be taken from the following description of execution examples and from the figures. What is more, all features described and/or pictorially represented, by themselves, or in any combination, in principle are the subject matter of the invention, irrespective of their summary in the claims. The content of the claims is also made part of the description.

BRIEF DESCRIPTION OF THE FIGURES

The invention is explained below in more detail using the figures, by means of execution examples, in which:

FIG. 3 shows, in a perspective partial representation, one of the transport-and-treatment elements, which includes a plurality of printing segments;

DETAILED DESCRIPTION

Figure 1:
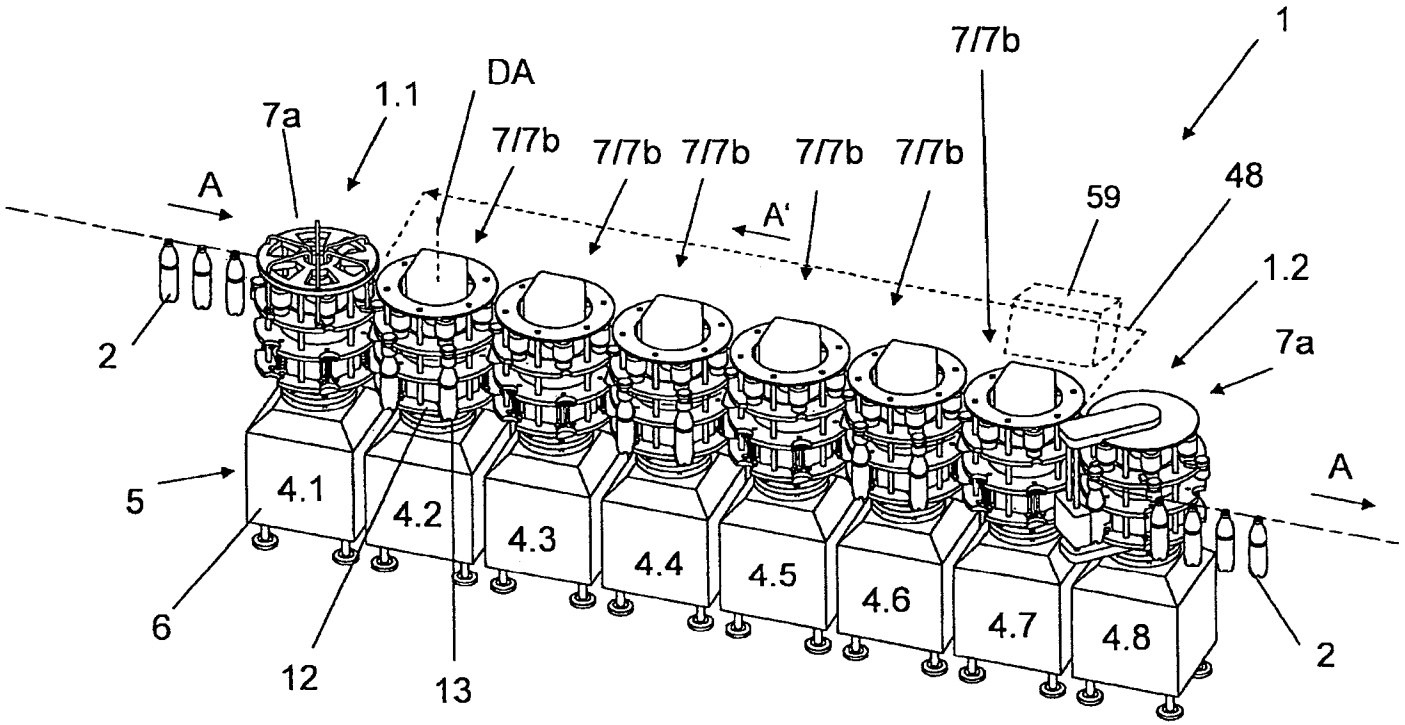
FIG. 1 shows, in simplified schematic and perspective representation, a device or system for treating packages by applying a design in the form of a multiple print to the packages.

FIG. 1 shows an apparatus 1 to apply a design, for example in the form of an imprint or multiple print, to a package 2, such as a bottle. The apparatus 1 does so either directly, to an external or shell surface of the package 2, or to labels already applied thereto.

Figure 2:
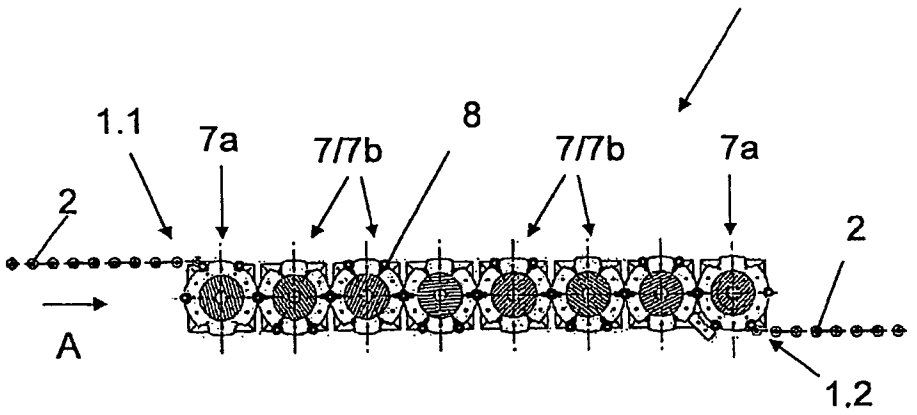
FIG. 2 shows, in simplified schematic representation, a plan view of the device or system for treating packages.

For printing, the packages 2 are supplied upright to the apparatus 1 or to a package inlet 1.1 thereof via an outer transporter in a transport direction A. The packages 2 then move, within the apparatus 1 on a transport path 3 made of consecutive arcuate segments. After printing, an outer transporter supplies the packages 2, which are still upright, to a package outlet 1.2 so that they can be put to further use. FIG. 2 schematically shows a transport route 3 of the package 2 as it moves through the apparatus 1 and while being taken away from the apparatus 1.

In detail, the apparatus 1 comprises a plurality of modules **4.1-4.*n* that are disposed consecutively in the transport direction A. In the particular embodiment shown, there are eight modules 4.1-4.8. The modules 4.1-4.8 have identical base units 5, each of which is equipped with the functional elements necessary for a task specific to that module 4.1-4.8**.

Each base unit 5 comprises a drive-and-control unit accommodated in a module housing 6, and a transport-and-treatment element 7, **7*a* that is arranged at the top of the module housing 6. The drive-and-control unit rotates the transport-and-treatment element 7, 7*a* about a vertical machine axis of its corresponding module 4.1-4.8. Each transport-and-treatment element 7, 7*a* has receptacles 8 to securely receive corresponding packages 2. The receptacles 8 are equiangularly distributed along the circumference of the transport-and-treatment element 7, 7*a*. Each receptacle 8 is designed to securely receive a package 2**.

The transport-and-treatment elements 7, **7*a* of the individual modules 4.1-8.1 are arranged consecutively in the transport direction A such that adjacent modules rotate in opposite directions. When synchronously driven, the transport-and-treatment elements 7, 7*a* collectively form a transport facility that moves packages 2 through the apparatus 1 on the multiply diverted package transport route 3 between the package inlet 1.1 and the package outlet 1.2. In the process, the individual packages 2 are each directly passed from the transport-and-treatment element 7 of a module 4.1-4.7 to the transport-and-treatment element 7, 7*a* of the module 4.2-4.8** that follows in the transport direction A.

In the representation of FIGS. 1 and 2, the transport-and-treatment element **7*a* of the first module 4.1 is synchronously driven clockwise, the transport-and-treatment element 7 of the next following module 4.2 is driven counterclockwise, and the transport-and-treatment element of the next module 4.3 is driven clockwise, and so on. A suitable controller synchronizes the individual modules 4.1-4.8**.

In the embodiment shown in the figures, the individual modules 4.1-4.8 are further provided consecutively such that the vertical machine axes of all modules 4.1-4.8 lie in a common vertical plane in which there are also transfer areas for the packages 2 to be passed from the transport-and-treatment element **7*a*, 7 of a module 4.1-4.7 to the transport-and-treatment element 7, 7*a* of a module 4.2-4.8** that follows in the transport direction A.

An inlet module 4.1 forms a package inlet 1.1 of the apparatus 1. It is preferable, however, that, at or prior to the inlet module 4.1, a pretreatment of the packages 2 take place at least in that area of the package area that is to be printed upon. Preferably, a plasma or corona treatment is carried out in the inlet module 4.1. This is expedient if a multi-color image is to be printed in subsequent modules using local inkjet printing stations or inkjet print heads.

It is at the printing modules 4.2-4.5 that follow the inlet module 4.1 where the multi-color printing takes place. In the case of color printing, each printing module 4.2-4.5 prints with ink of a different color. For example, the four printing modules 4.2-4.5 could print in yellow, magenta, cyan, and black respectively. The local receptacles 8 thus form printing positions.

A drying module 4.6 follows in the transport direction A. The drying module 4.6 dries the printed image in a suitable manner. Examples of drying modules 4.6 are those that dry by energy input such as by heat and/or by UV radiation.

After the drying module 4.6, an inspection module 4.7 checks for any errors. Any incorrectly printed packages 2 are discharged at or after the inspection module 4.7.

An outlet module 4.8 forms the package outlet 1.1 of the apparatus 1 at which the finally printed packages 2 leave the apparatus 1. In some embodiments, the outlet module 4.8, preferably is additionally also designed as a drying module.

Figure 3:
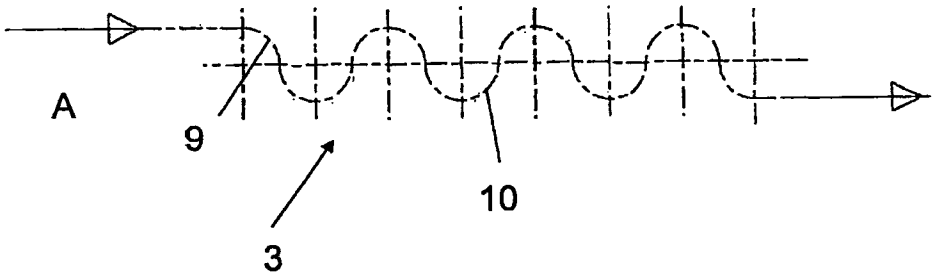
FIG. 3 shows, in schematic representation and in plan view, a transport or conveying route of the packages through the device of FIGS. 1 and 2.

As shown in FIG. 3, within the transport-and-treatment elements 7 of the inlet module 4.1 and the outlet module 4.8, the packages 2 move within an angular range of about 90° about the vertical machine axis MA of the inlet module 4.1 and the outlet module 4.8.

The remaining modules 4.2-4.7 carry the packages 2 along over an angular range of 180° about the vertical machine axis MA of those modules 4.2-4.7. Each module 4.2-4.7 carries out its particular function on a package 2 while the package 2 is within this angular range.

The modules 4.1-**4.*n*, and, in particular, at least the modules 4.2-4.7 that print on the packages 2, or the rotating transport-and-treatment elements 7 thereof, comprise printing segments 11. Each printing segment 11 is interchangeably mounted as a complete functional assembly unit of a rotor 12 that rotates about the corresponding vertical machine axis MA. The rotor 12 is supported at the respective module housing 6 or at a central support column 13 so as to be able to rotate about the vertical machine axis MA. The printing segments 11, which are provided around the circumference of the rotor 12 and are consecutive in the circumferential direction of the rotor 12, are wedge-shaped in plan view, and are located inside, i.e. in the area of the machine axis MA. The space enclosed by each printing segment 11 accommodates one or more different functional elements, including, for example, electronic control elements or computers 14 (FIG. 12) for controlling the printing segments 11**.

Each printing segment 11 forms, on a side that is located radially outside with reference to the machine axis MA, a recess 15 that accommodates a package 2 during the treatment. At least part of the package body, namely in the area of the package top or package opening, is suspended from holding-and-centering units 16 so that the package axis is oriented in the vertical direction and parallel to the machine axis MA and to a printing segment axis DA. In the area of the receptacle or recess 15, each printing segment 11 has at least one print head and possibly further functional elements necessary for printing on the package 2.

Each holding-and-centering unit 16 is held on a carrier 17 that is attached in the associated recess 15 via lateral grooves 18. Each holding-and-centering unit 16 has a primary part 19, which is held at a carrier 17 and a secondary part 20. The primary part 19 secures the holding-and-centering unit 16 to the carrier 17, to the receptacle 8, or to the printing segment 11, with correct alignment. For this purpose, the primary part 19 has a reference face 19.1, the complementary counterpart of which, in the printing segment 11, serves as a reference plane or reference face for adjustment relative to the print head. This creates a fixed common reference between a single package 2 and the print head.

The secondary part 20 has a gripper to suspend a package 2. For example, the secondary part 20 can have one or more of a mechanical gripper, a pneumatic gripper, and a vacuum gripper. Ideally, in a printing segment 11, the required holding force is passively applied to the primary part 19 and actively removed or released. This increases safety if there is no electricity or force-applying medium available. For example, the holding force can be applied through one or more permanent magnets.

The secondary part 20 comprises the active components, including all components necessary for the alignment, controlled rotation, or pivoting of the packages 2 during the treatment. These include elements required for aligning and/or rotating the packages during printing, and/or elements for supplying media in the form of gas and/or vapor, including those under pressure and/or for supplying vacuum etc.

Thus, the secondary part 20, which is supported so as to be able to rotate or pivot in the primary part 19 about the printing segment axis DA, in the embodiment shown forms the rotor of an electric actuating or angular drive for the alignment and controlled rotation or pivoting of the packages 2 during the treatment. For this purpose, the secondary part 20 is provided with a permanent magnet arrangement 21 having a multitude of permanent magnets. The permanent magnet arrangement 21 that, in a circumferential direction, has alternating magnetic north and south poles, interacts with a magnetic coil arrangement 22 provided at the carrier 17. This magnetic coil arrangement forms a stator of the actuating drive.

At the primary part 19, a coding 23 interacts with an incremental sensor 24 provided at the carrier 17 to form an encoder system to capture the random orientation of the primary part 19 and thus of the holding-and-centering unit 16. The alignment and/or controlled rotation of the packages 2 during printing takes into account this orientation and an allocation, which is known from or specified by the construction, between the primary part 19 and the rotational position of the secondary part 20 by rotating only the secondary part 20 and not the primary part 19. The incremental sensor 24 is stationary relative to the rotor 12 or the support column 13 and therefore revolves with them. The alignment and controlled rotation of the packages 2 about the printing segment axis DA takes place with reference to the respective printing segment 11 or with reference to local functional elements that are used in the treatment, in particular print heads.

Figure 9:
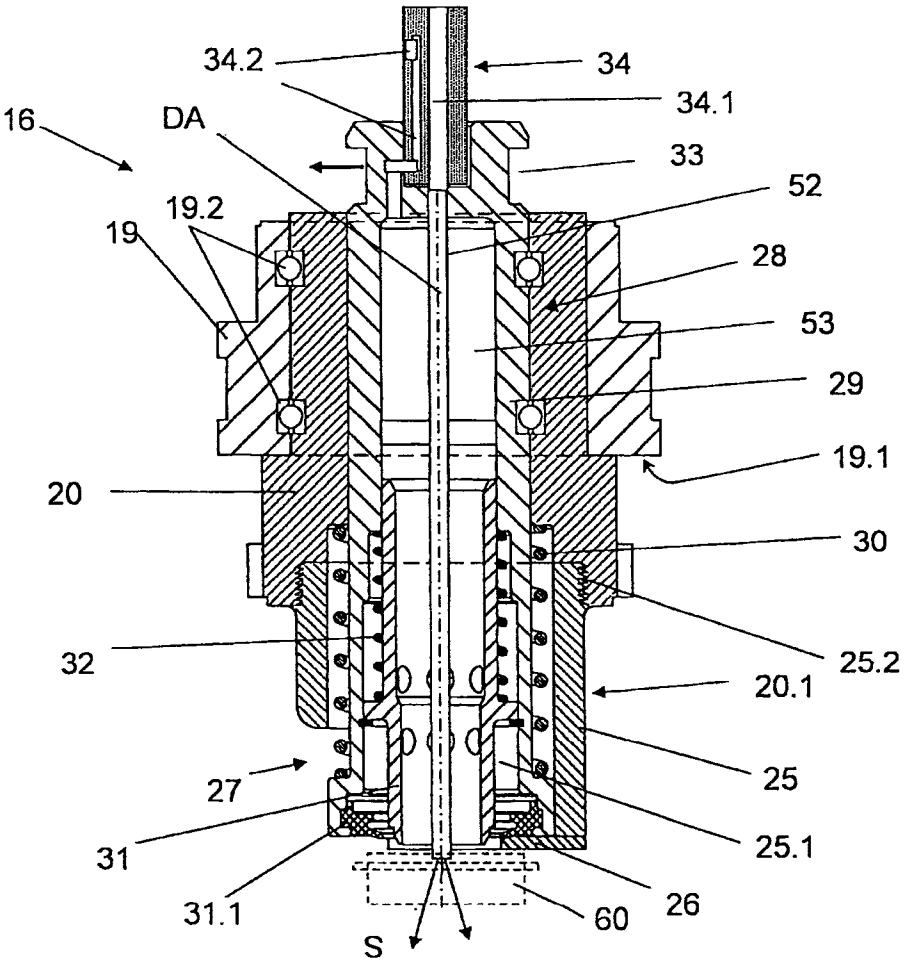
FIG. 9 shows a sectional representation through a holding-and-centering unit of the device of FIG. 1.

FIG. 9 shows the holding-and-centering unit 16 in section. As shown, the holding-and-centering unit 16 comprises a substantially ring-like primary part 19 and a substantially sleeve-like secondary part 20 that is supported from the primary part 19 and that is rotatable about the printing segment axis DA. The secondary part has its bottom length projecting over the underside of the primary part 19 and is formed there with a receptacle-and-foot-part 20.1. This is adapted to the type, shape, size etc. of the packages 2 and is part of a gripper for holding the as-yet empty or unfilled packages 2. In detail, a sleeve and a supporting plate 26 at a lower, open end of the sleeve 25 together form the receptacle-and-foot-part 20.1. The sleeve 25 has an axis that is coaxial with the printing segment axis DA. The sleeve 25 has a lateral opening 27, shown in FIG. 9. As shown in drawing "a" on the left-hand side of FIG. 10, a respective package 2, which in this case is a bottle, can be laterally inserted through the opening 27 into the receptacle-and-foot-part 20.1 (arrow B). Then, as shown in drawing "b" on the right-hand side of FIG. 10, the package 2 can be fixed at the receptacle-and-foot-part 20.1 such that the package 2 is suspended by a mouth edge 2.1 at the supporting plate 26.

In the secondary part 20, a centering-and-holding element 28 is arranged axially so that it can be displaced relative to the printing segment axis DA.

In the embodiment shown, the centering-and-holding element 28 comprises an outer sleeve body 29 that is preloaded by a compression spring 30 into a lower position. When in this lower position, the sleeve body 29 abuts the supporting plate 26 with its lower front face, and, with a package 2 held at the holding-and-centering unit 16, abuts the top, which faces away from the supporting plate 26, of the package 2 or abuts the local mouth edge 2.2 of the package 2 so that the package 2 is firmly clamped by the force of the compression spring 30 between the sleeve body 29 and the supporting plate 26 thus securing it against rotation.

Within the sleeve body 29, there is an axially-movable centering sleeve 31 that is coaxial with the printing segment axis DA. A compression spring 32 preloads the sleeve 31 into a lower position.

Figure 10:
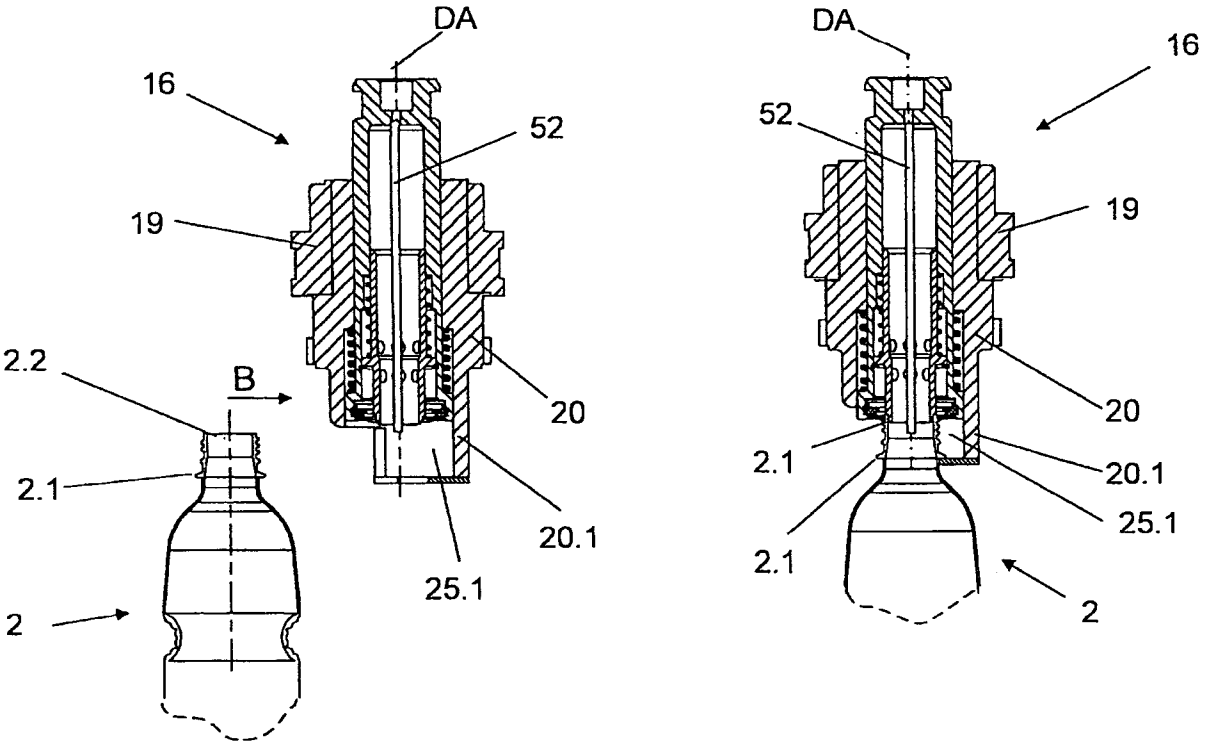
FIG. 10 shows, in positions a) and b), the holding-and-centering unit in section together with a package, designed as a bottle, in different operating states.

To receive a package 2, such as a bottle, the centering-and-holding element 28, which is formed by the sleeve body 29, the compression spring 30, the centering sleeve 31, and the compression spring 32, is raised against the effect in particular of the compression spring 30 by a lifting element that reaches behind a collar or an annular groove 33 of the sleeve body 29. The lifting element is provided at least at the package inlet 1.1 and at the package outlet 1.2. Following insertion of the package into the holding-and-centering unit 16, the centering-and-holding element 28 is lowered by the effect of the compression spring 30 and is thereby passively attached, by clamping, to the receptacle-and-foot-part 20.1. With the centering sleeve 31, or with a lower end, which has a conical design on the outside, of this centering sleeve 31, the package 2 is centered such that a package axis thereof is coaxial with the printing segment axis DA and such that the package 2 abuts, preferably with its package mouth 2.2 pressed tightly, against a seal 31.1 that encloses the centering sleeve 31. As shown in FIGS. 9 and 10, printing on a package 2, or on a bottle, takes place when the package is empty.

The package 2 is received and protected with its mouth region between the mouth flange 2.1 and the mouth edge 2.2 in the interior 25.1 of the sleeve 25. In particular, in a hygienic version, it is advantageous to design the holding-and-centering units 16, or their secondary parts 20, to protect the mouth region, a local thread, and a mouth 2.2 of each package 2 from contamination by, for example, stray ink during the printing operation.

To stabilize an as-yet empty package 2, a medium is used to charge and/or rinse it or its interior while it is fixed to the holding-and-centering unit 16 or after it has been fixed to the holding-and-centering unit 16. The medium can be gas and/or vapor, for example, a pressurized gas and/or vapor, or a support medium. For this purpose, a connecting element 34 is provided at the holding-and-centering unit 16 or at its centering-and-holding element 28. The internal pressure within the package 2 can continue to be controlled using this connecting element 34, using a line inside the holding-and-centering unit 16, and/or using a gas outlet. Ideally, the internal pressure is held constant over the entire transport path.

Preferably, the secondary part 20 is designed such that the format-dependent receptacle-and-foot-part 20.1 is detachably connected to the secondary part 20. To process packages 2 of different types, shapes, and/or sizes, the receptacle-and-foot-parts 20.1 at the holding-and-centering units 16 can each be exchanged for matching ones. The receptacle-and-foot-parts 20.1 which are adapted to the type, shape and/or size of the packages 2 to be treated, are then connected, and secured against rotation with the secondary part 20. This connection can be carried out, for example, using a quick-change mechanism, a quick-action coupling, a screw fastening, and/or a clamp fastening.

Figure 11:
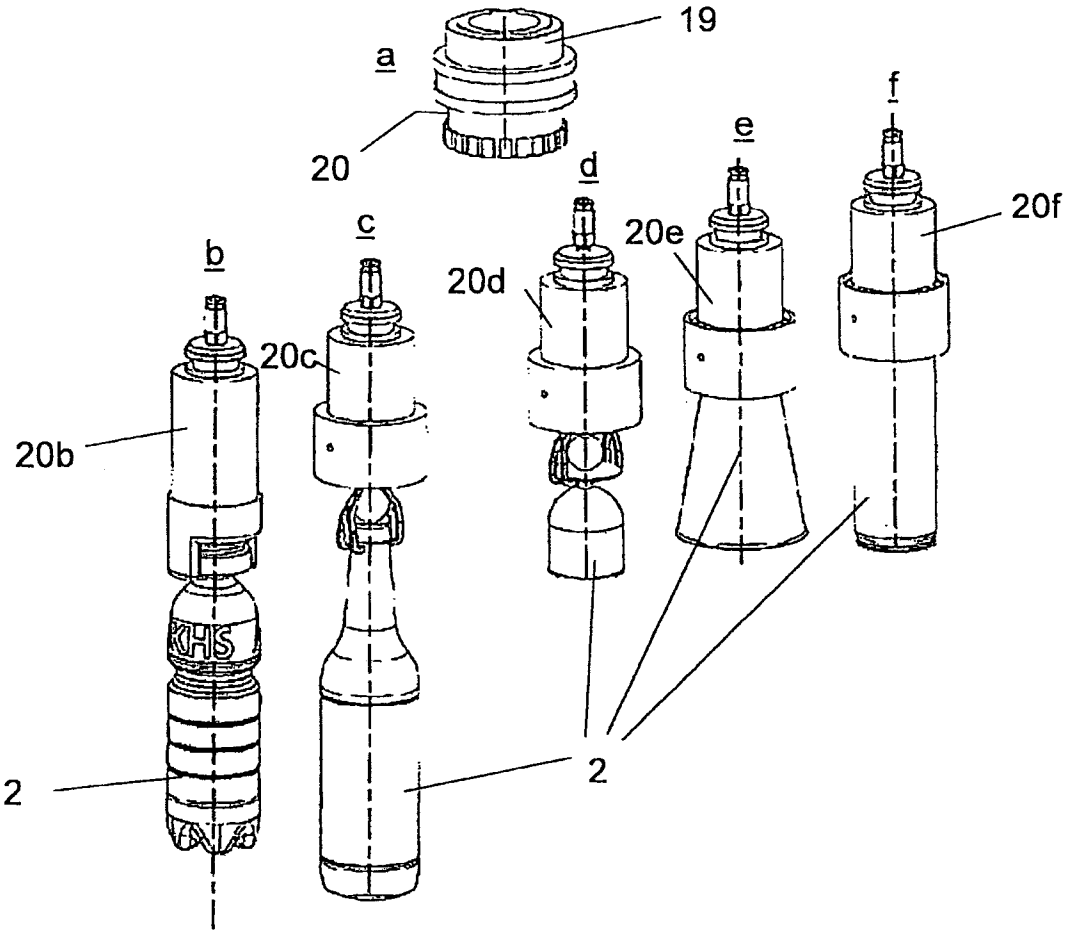
FIG. 11 shows, in position a) in perspective representation, a primary part of a holding-and-centering unit and, in positions b)-f), different secondary units that can be combined with the premier parts of a holding-and-centering unit.

FIG. 11 again shows, in position (a), the primary part 19 of a holding-and-centering unit 16 in individual representation and, in positions (b)-(f), different secondary parts for different packages 2, with these secondary parts e.g. having been formed at least partly by using different receptacle-and-foot-parts 20.1. To differentiate them from each other, the secondary parts 20 in FIG. 11 are designated 20*b*-20*f*. In the embodiments shown, the secondary parts 20*b*-20*e* are each designed as mechanical grippers for holding the packages 2 at their tops or in the area of their openings. These grippers can be operated, for example, by compressed air. The secondary part 20*f* is a vacuum gripper for using a vacuum to hold a package 2 at a top thereof, or in an area of an opening thereof.

The holding-and-centering units 16 and, preferably, the secondary parts 20 thereof, can be provided with a unique identifier, such as an RFID that that contains the identification of the holding-and-centering unit 16 and information about the type of holding-and-centering unit 16 and/or the type of the secondary part 20. The corresponding information can then be read out by at least one reader unit of the apparatus 1 and/or of the respective printing module 4.1-4.*n*, for example for monitoring or control purposes.

Figure 12:
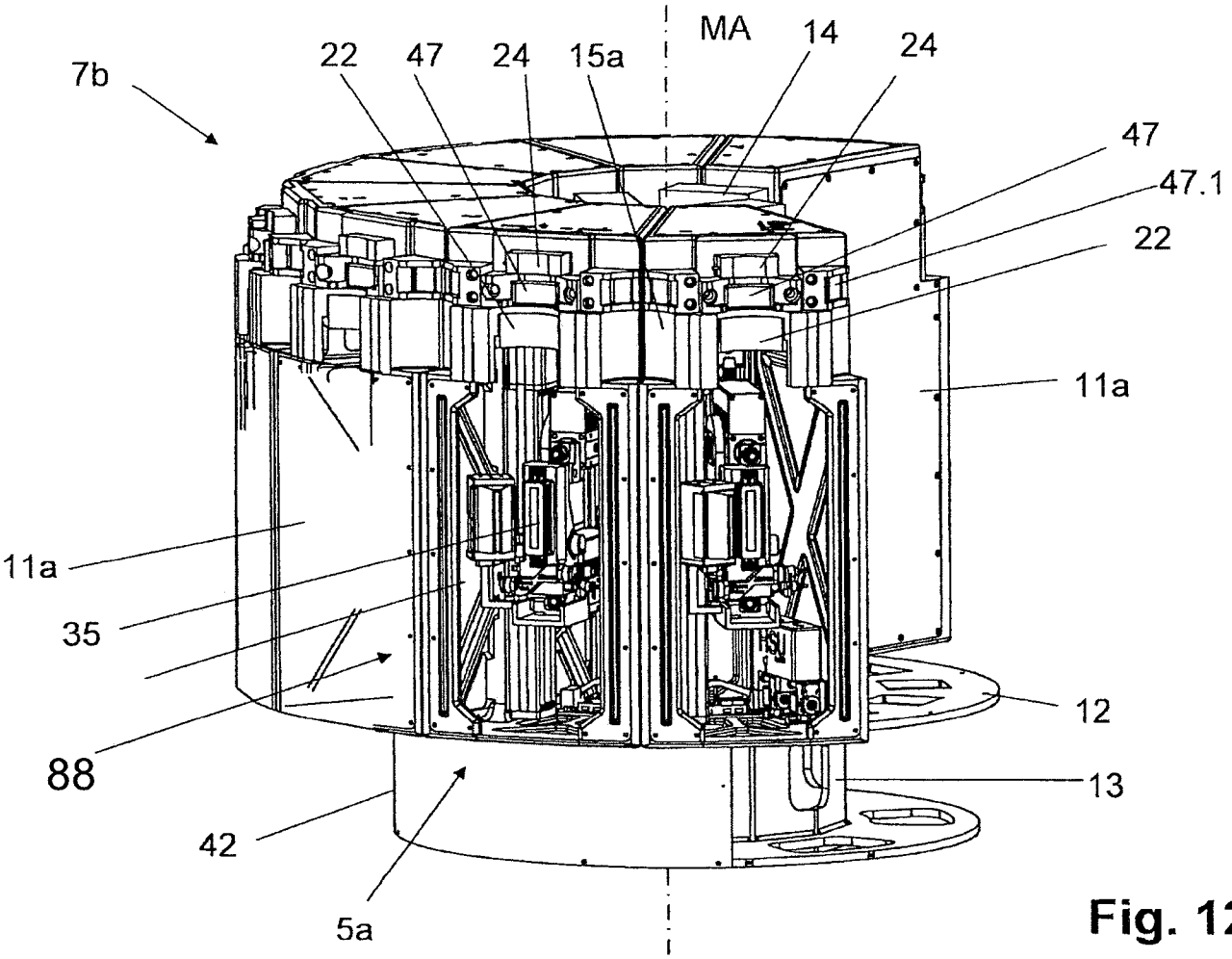
FIG. 12 shows, in perspective representation, a transport and treatment element of a further embodiment of the invention, preferably for use in the device or system of FIG. 1.
Figure 13:
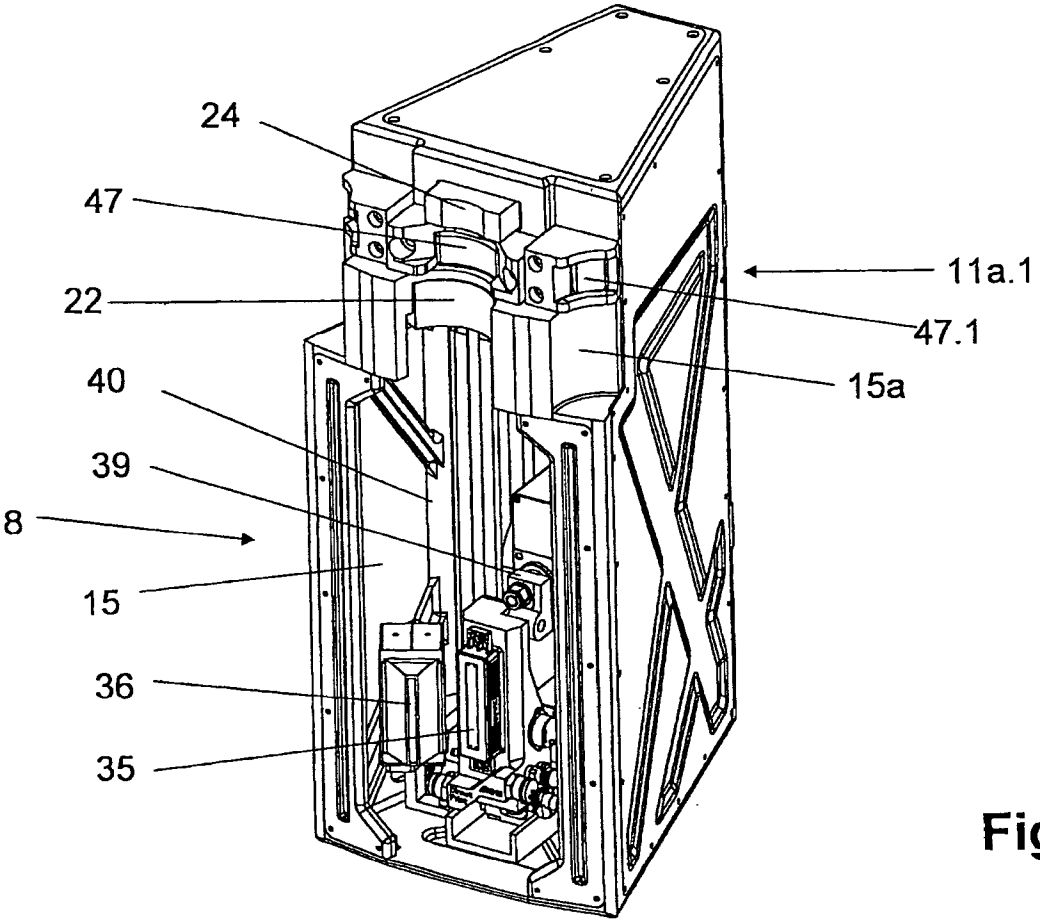
FIGS. 13 and 14 show a printing segment of the transport and treatment element of FIG. 12 in different views.
Figure 14:
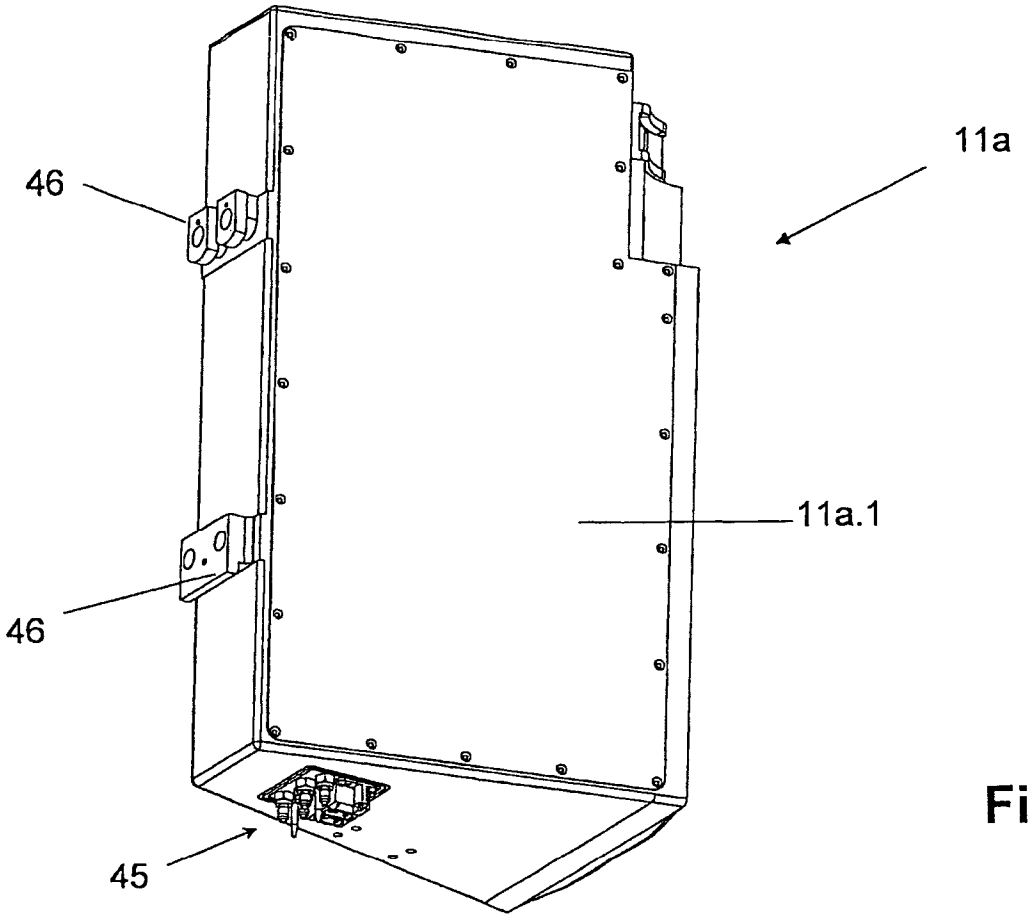
Figure 15:
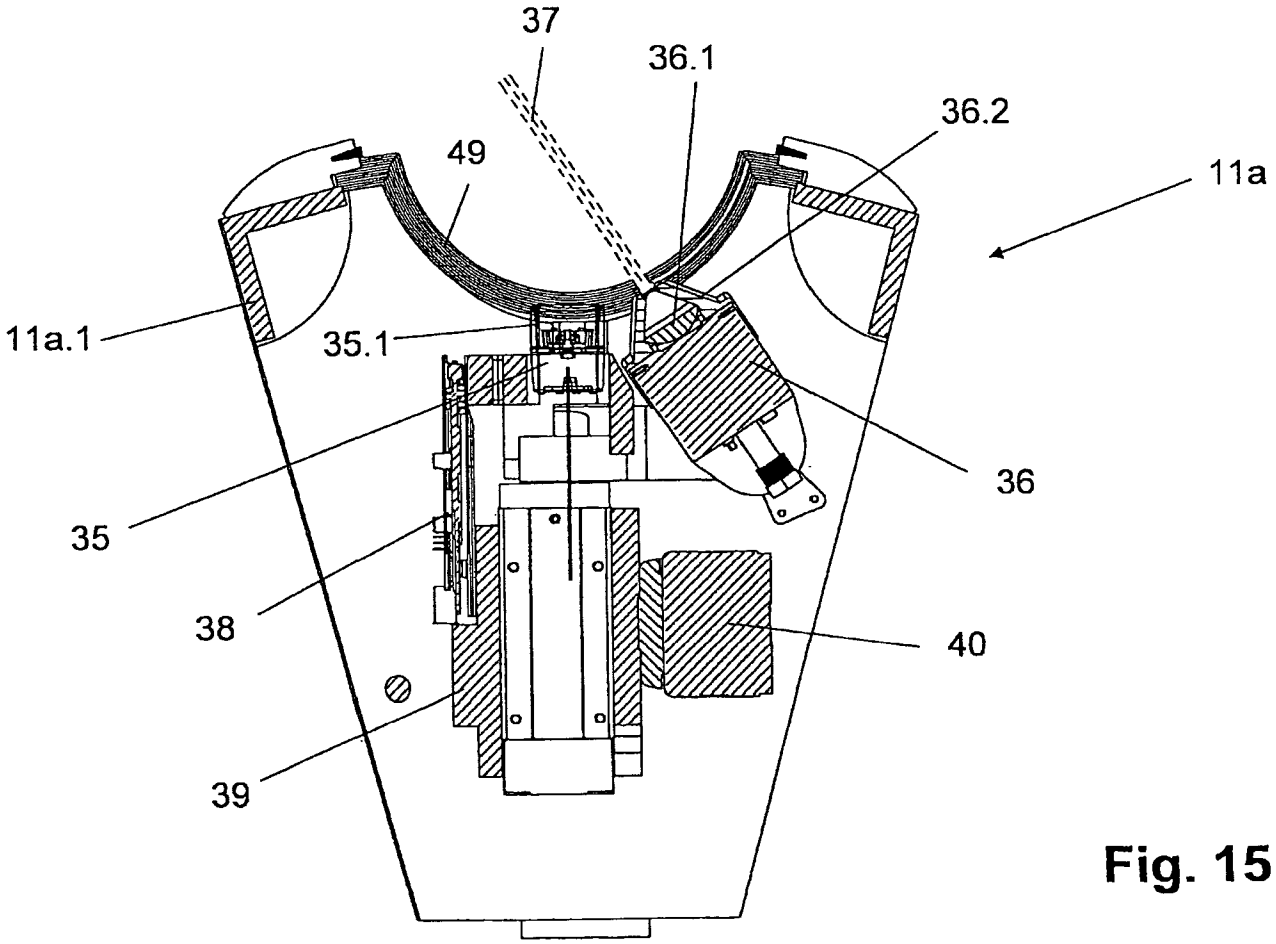
FIG. 15 shows a simplified horizontal section through the printing segment of FIGS. 13 and 14.
Figure 16:
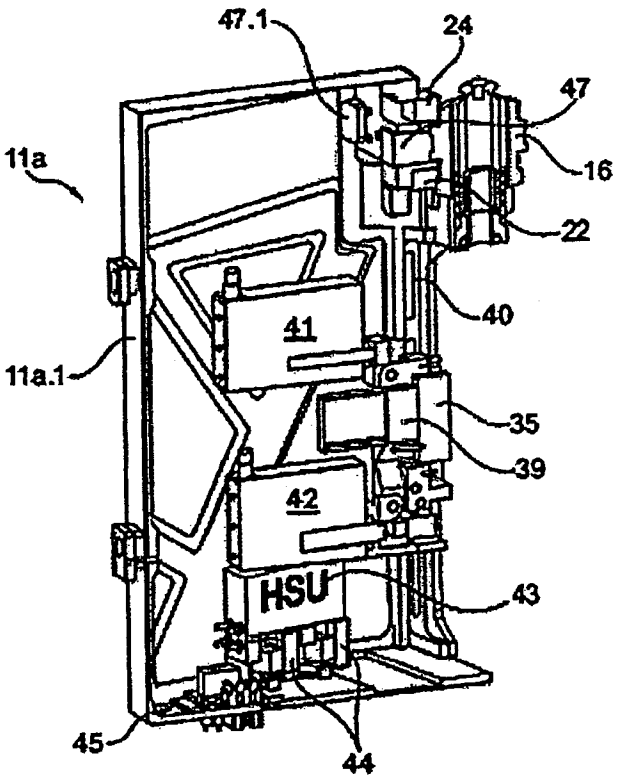
FIG. 16 shows a simplified vertical section through the printing segment of FIGS. 13 and 14.

FIG. 12 shows an alternative transport-and-treatment element 7*b* that can be used in the apparatus 1 instead of the transport-and-treatment element 7 and that is distinguished from the transport-and-treatment elements 7 by having printing segments 11*a*, which form the transport-and-treatment elements 7*b*, that do not have the height-adjustable slide 17. The holding-and-centering units 16 are instead held directly, i.e. not height-adjustably, at the respective printing segment 11*a*. The incremental sensor 24 and the electromagnet arrangement 22 are also provided at a suitable location, such as the printing segment 11*a* or a housing 11*a*.1 thereof.

The printing segments 11*a* are again provided consecutively on the rotor 12, which is rotatable and drivable about the vertical machine axis MA, and which is supported at the support column 13 of a base unit 5*a* that corresponds to the base unit 5.

Within its segment-like housing 11*a*.1, a printing segment 11*a* has the functional elements necessary for printing the packages 2. Examples of such functional elements include an inkjet print head 35 having electronically controlled exit nozzles for ink, with these nozzles being arranged in at least one row parallel to the printing segment axis DA. Each print head 35 is allocated a drying facility 36 for immediate drying of ink applied to the package 2 or for the immediate drying of the print image applied to the package 2. In the embodiment shown, the drying facility 36 comprises an infrared emitter for emitting a band-shaped region of infrared radiation 37 that covers at least the entire print image that is applied by the print head 35. The drying facility 36 is provided opposite the print head 35 and is offset by an angle relative to the printing-segment axis DA. During printing of a package 2, the drying facility 36 is rotated about the printing-segment axis DA and is controlled such that the infrared radiation 37 dries or substantially dries the ink applied with the print head 35.

In a manner not shown in more detail, a cooling medium cools the drying facility 36. Suitable cooling media include air and/or water.

The print head 35, the drying facility 36, and electronics 38 for implementing at least a driver stage of the print head 35 are provided on a common slide 39 that is adjustably guided on a support column 40 by an actuating drive 41 in the direction of the printing-segment axis DA. In the embodiment shown, the print head 35 and the drying facility 36 are adjustable via an actuating or angular drive 42 provided at the slide 39, by pivoting, preferably by pivoting about at least one axis that is oriented vertically to the printing-segment axis DA and tangentially to the circumference of the transport-and-treatment element 7*b* formed by the printing segments 11*a*. The location of the print head 35 can be adapted to the location of surface of the package that is to be printed upon such that the print head 35, with its nozzle openings, is arranged as closely as possible to the surface and with the axes of its nozzle openings oriented as vertically as possible relative to the package surface that is to be printed upon.

To avoid contamination of the printing segment 11*a* by sprayed ink, the print head 35 is designed with a protective element 35.1 that limits the printing space toward the outside. The protective element 35.1 does so by abutting the package 2. A suitable protecting element 35.1 is lamellar, covered with scales, and/or rubber-ball-like.

To design the focused, band illuminating infrared beam 37, The drying facility 36 has an optical beam forming element 36.1 in the form of a cylindrical lens and a protection and guidance aperture 36.2. This results in a focused infrared beam that illuminates a band-shaped region.

Other functional elements of the printing segment 11 can be accommodated within the housing 11*a*.1. These include a pressure-compensation tank 43 for the ink, preferably heated in a temperature-controlled manner. Other functional elements that can be accommodated with the housing 11*a*.1 include pumps 44 for supplying ink and for discharging excess ink, and electronic control elements for controlling at least the printing segment 11, and the drives 41, 42. In some embodiments, the pressure compensation tank 43 and the pumps 44 are part of an ink control module. In addition, or alternatively, it is possible to provide ink control modules at the modules 4.1-4.8 used for printing the packages 2. It is also possible to instead provide a central ink control module that is common to all modules.

On the underside of the housing 11*a*.1 there is a coupling unit 45. Plugging into this coupling unit 45 can make all electrical and fluid connections. This would include all electrical connections required for electrical power, such as for drives, and connections for data transmission, to enable transmission of control data and monitoring data. It also includes fluid connections for the cooling of functional elements and for supplying ink.

Mechanical holding-and-centering elements 46 are provided on the narrow rear, located radially inside with reference to the machine axis MA, at the housing 11*a*.1 of each printing segment 11*a*. These provide a secure and accurate plug-in connection between the printing module 11*a* and either the rotor 12 or a rotor element concentrically enclosing the machine axis MA is at least partly possible.

On the inside of the recess or receptacle 15 is an aperture-like wall 49 that closes the interior of the housing 11, except for openings for the slide 17, the print head 35, and the infrared unit 36.

In embodiments disclosed thus far, holding-and-centering units 16 have been part of the individual modules 4.1-4.*n* or printing segments 11 or 11*a*. However, there are also embodiments in which the holding-and-centering units 16 are pucks that receive packages 2 at the package inlet 1.1 and only release packages 2 at the package outlet 1.2. In these embodiments, each package 2 is continuously held on the transport route 3 between the package inlet 1.1 and the package outlet 1.2 by one and the same holding-and-centering unit 16. In the course of the transport route 3, the holding-and-centering unit 16 is passed from one transport-and-treatment element 7, 7*a*, 7*b* or local receptacle 15 to another transport-and-treatment element 7, 7*a*, 7*b* or local receptacle 15 that follows in the transport direction A. For this purpose, there are mechanisms for holding and re-releasing the holding-and-centering units 16. These mechanisms are provided at the slides 17 of the printing segments 11, 11*a*. Examples of such mechanisms include controllable electromagnets 47 that interact with the holding rings 19.1. Other examples include gripper-like receptacle elements, holding elements, and/or transfer elements.

Figure 4:
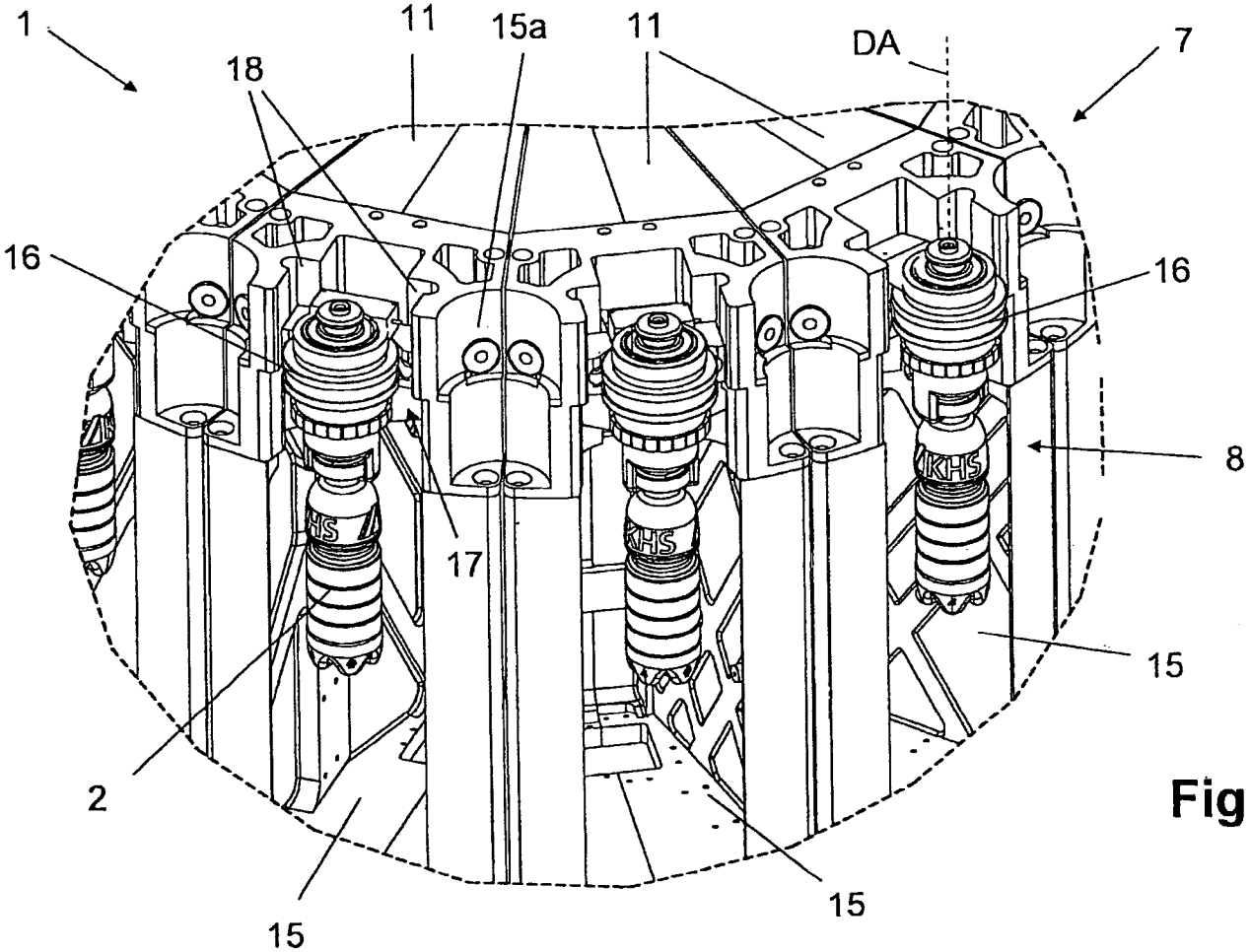
FIG. 4 shows, in perspective partial representation, one of the transport-and-treatment elements.
Figure 5:
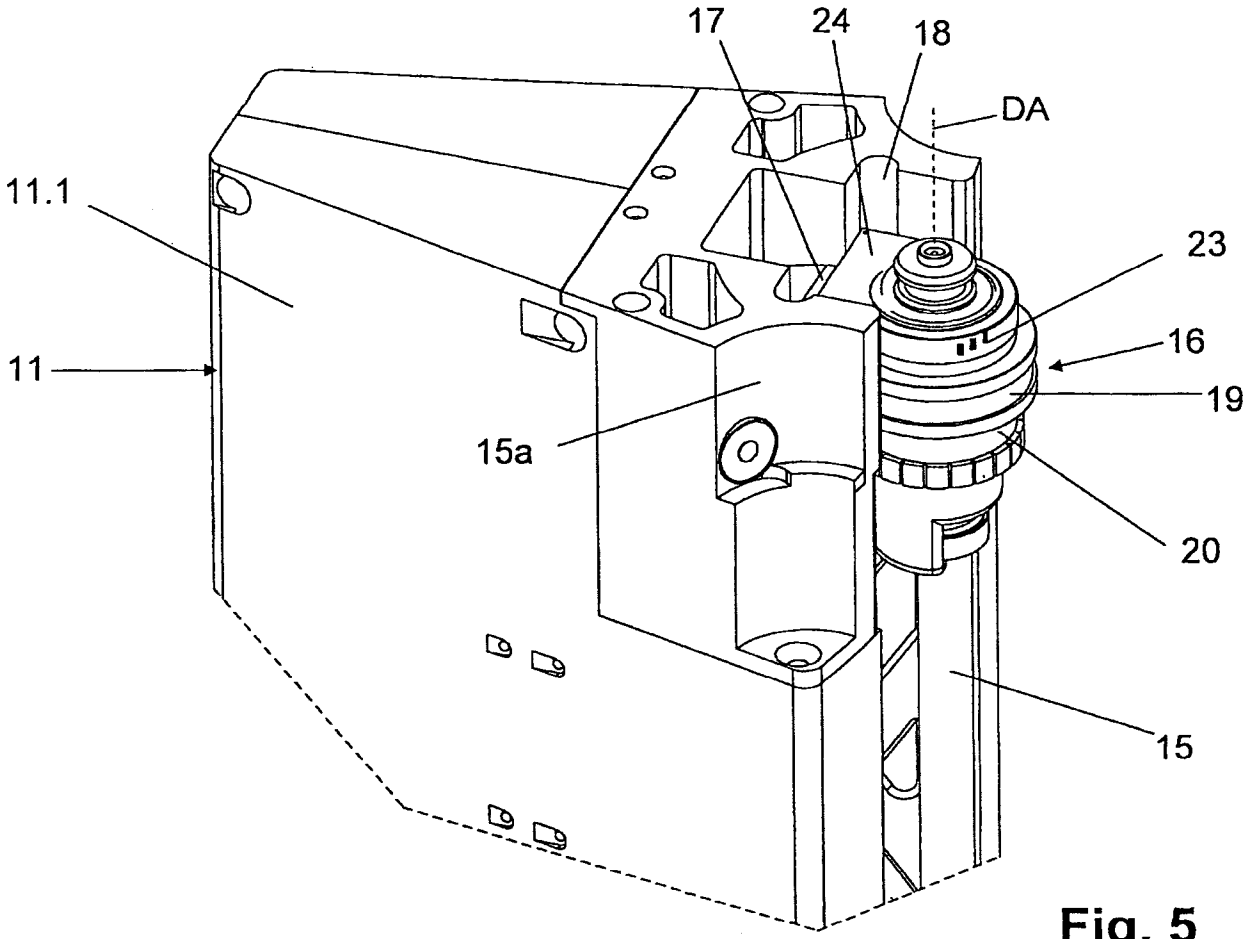
FIG. 5 shows, in perspective representation, a printing segment of the transport-and-treatment element of FIG. 4.
Figure 7:
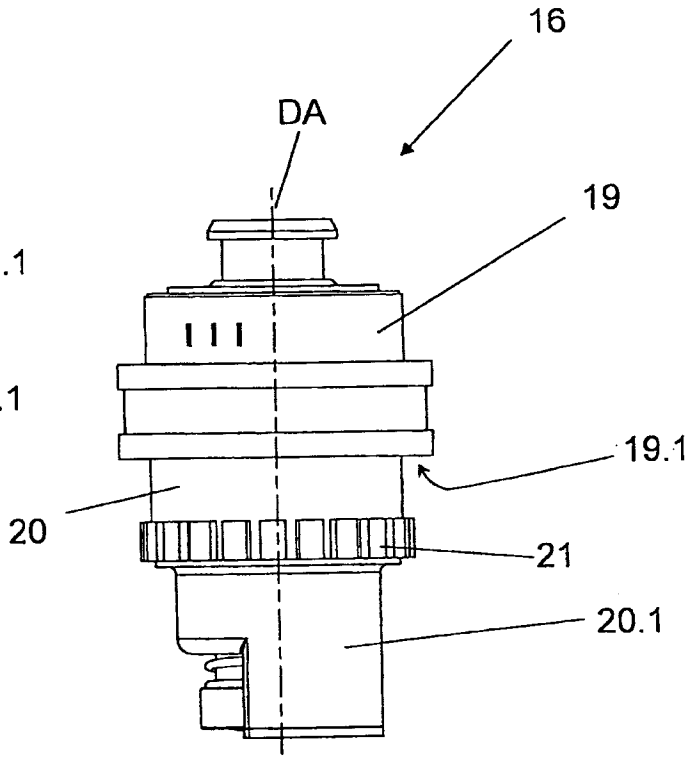
FIGS. 6-8 shows, in different representations, a holding-and-centering unit of the device of FIG. 1, also together with a package designed as a bottle.
Figure 6:
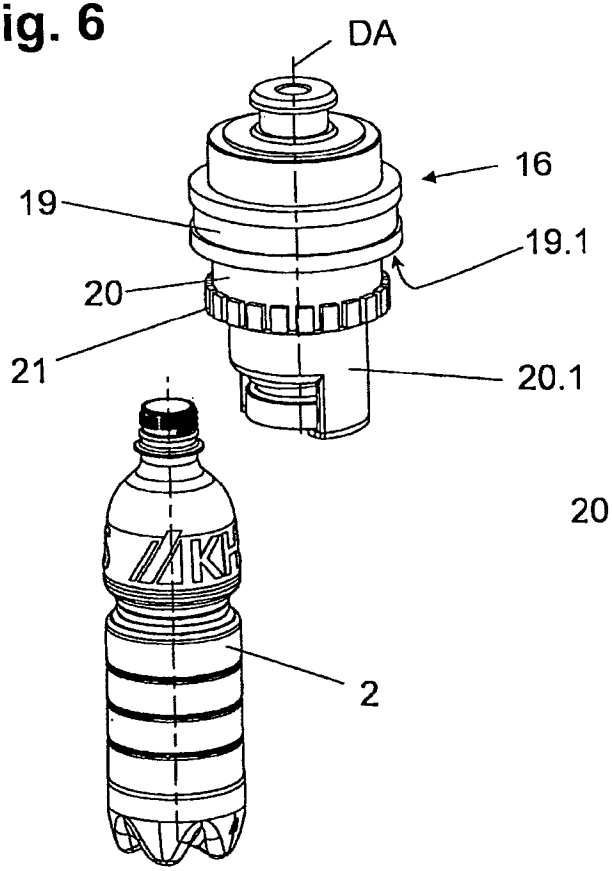
Figure 8:
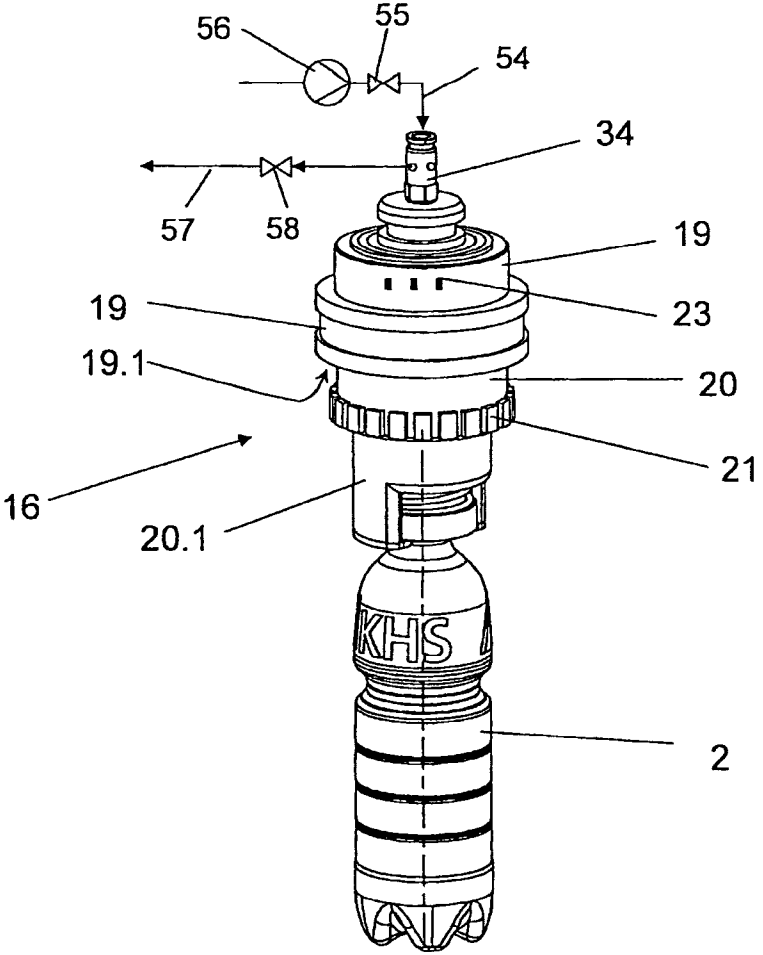

Referring back to FIG. 1, the holding-and-centering units 16 are returned in a transport direction A' on a puck-transport path 48 from the package outlet 1.2 to the package inlet 1.1. The puck-transport path 48 is formed by independent transport-and-treatment elements, or by the transport-and-treatment elements 7. In the latter case, between every pair of holding-and-centering units 16, there is an additional receptacle 15*a* for receiving a holding-and-centering unit 16 (FIGS. 4 and 12), namely in the versions shown, by corresponding design of the printing segments 11, la or the housing 11.1, 11*a*.1 thereof.

Figure 17:
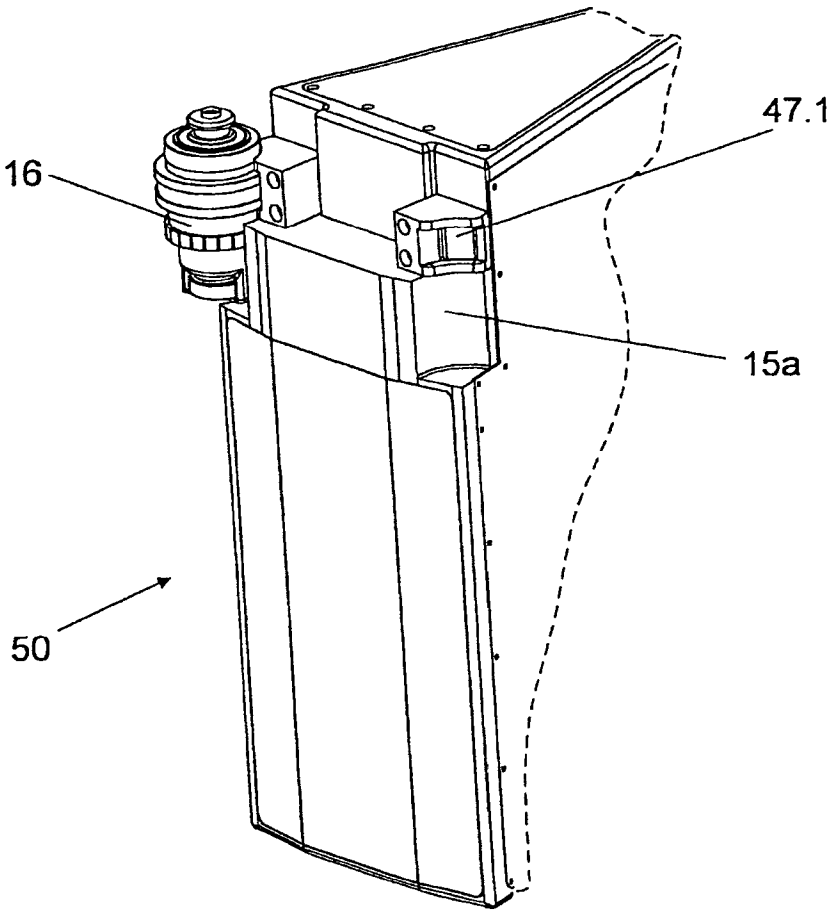
FIGS. 17 and 18 each show, in perspective partial representation, a dummy segment for use in the device or system of FIG. 1 or in the transport and treatment element of FIG. 12.
Figure 18:
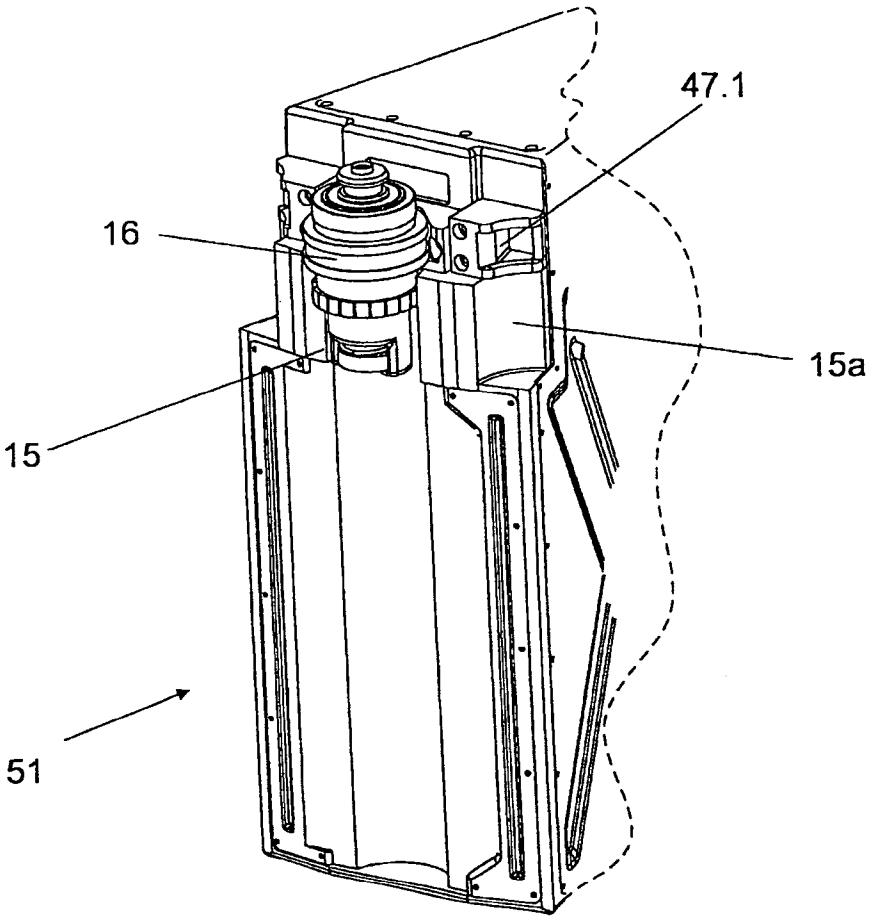

In FIGS. 17 and 18, two different dummy segments 50, 51 are shown. These dummy segments 50, 51, or the housings thereof, correspond to the printing segments 11*a* in shape, size, or dimension. The dummy segments 50, 51 differ from the printing segments 11*a* by not having all functional elements required for printing the packages 2.

The dummy segments 50, 51*b* are arranged at the transport-and-treatment elements 7*b* between printing segments 11*a* to reduce the number of treatment positions formed by the printing segments 11*a*. This is useful for reducing the number of packages 2 treated per unit time. The dummy segments 50, 51 can also be used for returning the holding-and-centering units 16, which are pucks, from the package outlet 1.2 to the package inlet 1.1, where they are held in areas that correspond to either the receptacles 15 or the receptacles 15*a* of the dummy segments 50, 51.

FIG. 12 shows an annular tank 42 disposed on the base unit 5*a* and surrounding the support column 13. The annular tank 42 receives ink, via a rotary connection, from either the pressure compensation tanks 43 or the local pumps 44.

As noted above, during treatment, a package 2 is charged and/or rinsed with a medium. The medium is either gas and/or vapor, and is preferably a pressure medium in the form of gas and/or vapor.

The medium is supplied to the interior of the package 2 at a treatment position 88 of at least of one module 4.1-4.8, preferably at the treatment positions 88 of at least one of the printing modules 4.2-4.5. The medium rinses and/or sterilizes the package interior. As a result, the apparatus 1 provided for printing on the package 2 can, at the same time, also be used for sterilizing the package 2. This substantially reduces the machine technology involved in a complete system for the aseptic filling of products into the packages 2 and also reduces the total duration needed for printing, filling, and closing the packages 2. Above all, however, because of the lengthy exposure of the package interior to the medium, a very good germ-killing rate can be achieved with smaller quantities of sterilizing media at lower concentrations and with reduced energy consumption.

Examples of suitable rinsing and/or sterilizing media include those based on hydrogen peroxide ($H_2O_2$) or ozone. Those media based on $H_2O_2$ include a sterilizing component and an activation-and-drying component. The sterilizing component can be a hot, vaporous and $H_2O_2$-containing medium, for example hot sterile air with a sufficiently high proportion of vaporized aqueous $H_2O_2$ solution having a sufficiently high $H_2O_2$ concentration, usually a 25% to 35% solution, and ideally a 30% to 32% solution. The activation-and-drying component can be a hot gas and/or vapor without $H_2O_2$ such as sterile air without $H_2O_2$. $H_2O_2$ is removed from the sterilizing component by condensing on the internal surfaces of the treated packages 2. The condensed $H_2O_2$ is then activated with the activation-and-drying component. As a result of such activation, free oxygen radicals separate from the $H_2O_2$. These free oxygen radicals then go on to participate in the killing of microorganisms. The activation-and-drying component also rinses and dries the internal surfaces of the package 2.

The rinsing and/or sterilizing of the packages 2 can take place at one or more modules 4.1-4.8. When using a sterilizing medium based on hydrogen peroxide, the packages 2 can be charged with the components of the sterilizing medium at different modules 4.1-4.8 that are consecutive in the transport direction A. In principle, however, there is also the possibility that the packages at the treatment positions 88 of one and the same module 4.1-4.8 are initially charged with the sterilizing component and then with the activation-and-drying component, wherein this treatment then for example is repeated at least once, namely at the treatment positions of a module 4.2-4.8, which follows in the transport direction A from that module 4.1-4.7 in which, previously, a first rinsing and/or sterilizing of the packages has already taken place.

To achieve the most effective treatment possible of the interior of the packages 2 with the sterilizing medium or with the components thereof, each holding-and-centering unit 16, which can be a puck, has an injection tube 52 as shown in FIGS. 9 and 10. The injection tube 52, which is coaxial with the axis of the holding-and-centering unit 16, forms a channel. An upper end of the channel connects to a gas path 34.1 in the connecting element 34, which acts as an actuating coupling. A lower, open end of the channel slightly protrudes over the seal 31.1 that forms the mouth system for the package 2. Within the holding-and-centering unit 16, an annular channel 53 encloses the injection tube 52. The annular channel 53 is open at the mouth system for the package 2 and connects to a further gas path 34.2 in the connecting element 34. During sterilization and/or during rinsing, the sterilizing or rinsing medium is introduced under pressure and/or in pulses via the lower, open end of the injection tube 52 into the packages 2, as indicated in FIG. 9 by the arrows S.

To sterilize a package 2, one connects the connecting element 34 of a holding-and-centering unit 16 to a source 56 that provides the sterilizing medium under pressure, for example by providing the sterilizing component and the activation-and-drying component in temporal succession. This connection can be made via at least one connection at the device end and via at least one fluid connection 54 in the relevant module 4.1-4.8 via a control valve 55. During the treatment, the annular channel 53, which is open towards the package interior, is connected via the second gas path 34.2 to a further fluid channel 57 in which a control valve 58 is also provided. When the control valve 58 opens, any gas and/or vapor medium that was displaced during the introduction of the sterilizing and/or rinsing medium into the package 2 can drain via the annular channel 53, the second fluid path 34.2 and the fluid connection 57. The device-end connections for the connecting elements 34 are provided at the printing segments 11, 11*a*, at the transport element 7, or at the rotor 12.

At those modules 4.1-4.8 at which a treatment of the packages 2 with the sterilizing medium does not take place, the packages 2 are preferably rinsed or charged with a suitable medium. Suitable media include a sterilizing medium, a support medium, and/or an inert gas. A suitable sterilizing medium would be a pressure medium, in the form of gas and/or vapor as a protective medium and/or as a support medium. A suitable inert gas would be nitrogen or sterile air. For this purpose, the holding-and-centering units 16 are connected, with their respective connecting elements 34, to a source that provides the suitable medium using one or both gas paths 34.1, 34.2.

To also ensure the sterility of the holding-and-centering units 16, at least one station 59, shown in broken lines in FIG. 1, is provided on the transport path 48 that serves to return the holding-and-centering units 16. At this station 59, holding-and-centering units 16 are treated with a cleaning and/or sterilizing medium so that only cleaned and sterilized holding-and-centering units 16 reach the package inlet 1.1. In some embodiments, the station 59 is formed by successive cleaning and/or sterilizing modules in the transport direction A' of the transport path 48, each of which has a rotor-like transport-and-treatment element that is driven to rotate about a vertical machine axis. Such a transport-and-treatment element would have, at its circumference, treatment positions for cleaning and/or sterilizing the holding-and-centering units 16.

FIG. 9 shows, using broken lines, a rinsing cap 60 with which a holding-and-centering unit 16 can be closed at its mouth, i.e., at its seal 31.1 such that the channel of the injection tube 52, which is sealed towards the outside via the rinsing cap 16, is connected to the annular channel 53. The rinsing cap 60 is held at the holding-and-centering unit 16 with the receptacle-and-foot-part 20.1 thereof so that it abuts, sealed with its cap edge, and is pressed against the seal 31.1. With the rinsing caps 60, a CIP cleaning and/or sterilization not only of all holding-and-centering units 16 but also of all connections and flow paths of the apparatus 1 is possible. Prior to this cleaning and/or sterilization, all holding-and-centering units 16 are provided with a filling cap 60. The cleaning and/or sterilization then preferably takes place with the apparatus 1 running. The holding-and-centering units 16, which are provided with the rinsing caps 60, are moved through the device without packages 2. After the CIP cleaning and/or sterilization, the rinsing caps 60 are removed from the holding-and-centering units.

Figure 19:
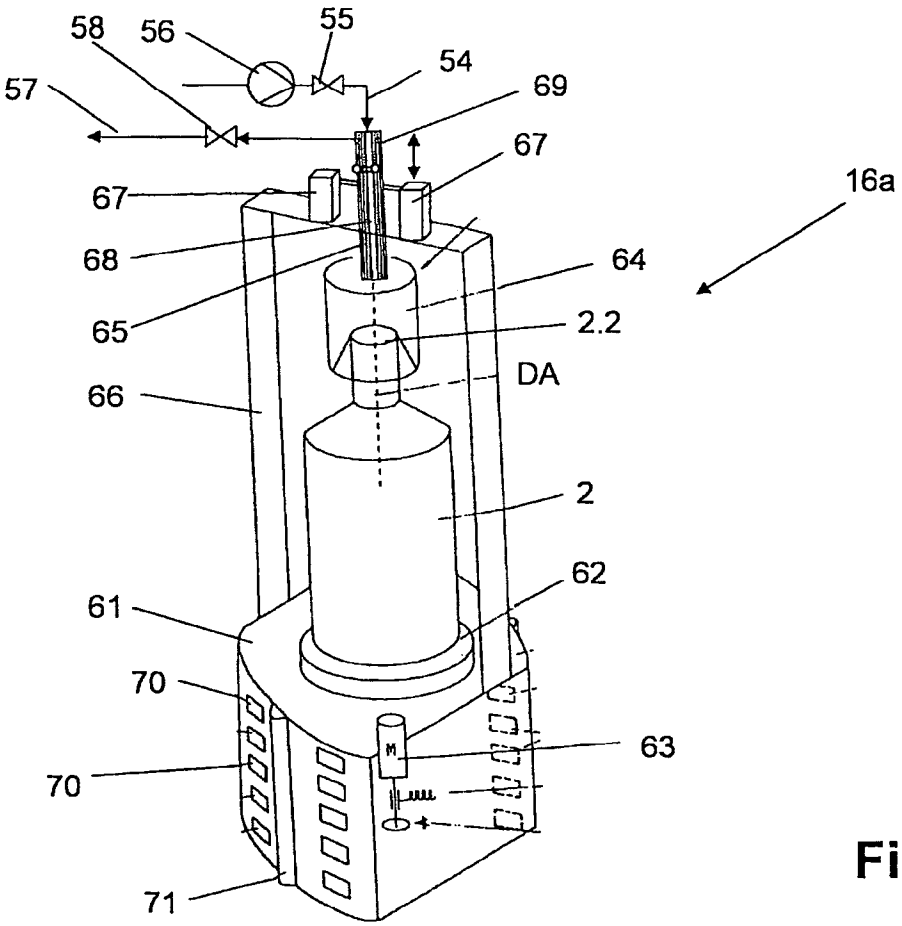
FIG. 19 show, in simplified representation, a further embodiment of a holding-and-centering unit.

FIG. 19 shows a simplified representation of a holding-and-centering unit 16*a* that, with corresponding design and/or adaptation of the apparatus 1, can be used together with a multitude of similar centering units 16*a* instead of the centering units 16. The holding-and-centering unit 16*a* comprises a socket or a base 61 that forms the primary part and at the top of which a package receptacle 62 is formed by a turntable that can be rotated in a controlled manner about the printing-segment axis DA by an electric motor actuating drive 63 that is accommodated in the base 61. This would typically occur during printing of a package 2 that is standing with its bottom on the package receptacle 62.

In particular, during printing, a centering head 65 holds the package 2 at its top, i.e. at the local package mouth 2.2. For this purpose, the centering head 64 is pressed against the package 2 so as to abut it in a sealed manner. In this process, pressing occurs using a centering opening accommodating the package 2 in the area of its package mouth 2.2. The centering head 64 is provided at a die 65 that is arranged coaxially with the printing-segment axis DA. The centering head 64 is displaceable along this printing-segment axis DA by a specified stroke, and is rotatable about the printing-segment axis DA at a holding-or-supporting element 66 of the holding-and-centering unit 16*a*. The package receptacle 62 and the centering head 64 form the secondary part of the holding-and-centering unit 16*a*.

In the embodiment shown, that package 2 is a bottle, such as a PET bottle.

In FIG. 19, the holding-or-supporting element 66 is reproduced as a U-shaped frame. However, other embodiments for the holding-or-supporting element 66 are also possible. Spring means 67 generate the pressing force needed to secure the single package 2 on the package carrier 62. To connect the single package 2 to be treated with the holding-and-centering unit 16*a* and to separate the treated single package 2 from the holding and centering unit, the centering head 64 is raised against the effect of the spring means 67.

In this embodiment, the centering head 64 and the die 65 are designed such that the interior of a package 2 can be charged with the sterilizing and/or rinsing medium and, where required, also with the sterilizing support medium in the form of gas and/or vapor, as was described above in connection with the holding-and-centering units 16. For this purpose, gas paths 68 are formed in the centering head 64 and also in the die 65. These gas paths 68, at least during the treatment of the package 2, are connected to the package interior thereof or with an injection tube that reaches into the package interior and, via a connecting element 69 or via the local gas path 68, is connected with the fluid connections 54, 57 for supplying the sterilizing and/or rinsing medium and for discharging the medium in the form of gas and/or vapor from the package interior.

Electrical contacts 70 on the external surface of the base 61 electrically connect the actuating drive 63 with an external supply voltage, and also enable data transmission, including transmission of control and measurement data. Mechanical centering elements 71 at the base 61 enable accurate positioning of each holding-and-centering unit 16*a* or its base 61 at an appropriate the treatment position.

An advantage of the disclosed apparatus is that the sterilization and/or rinsing of the package 2 takes place during printing. This saves time because time needed for printing on the package 2 can also be used for sterilizing the package 2. It also saves cost because the apparatus used for printing on the package 2 is the same apparatus that is used for sterilizing and/or for rinsing the package 2. This considerably simplifies the machine technology required, especially for a system for printing on package 2 and for aseptically filling products into those packages. The gas and/or vapor medium used as a sterilizing medium simultaneously serves as a support medium for stabilizing the package 2 during printing or during application of a design and design features on the package 2.

An advantage of the apparatus described herein is that the holding-and-centering units 16, which are pucks, the slides 17, the print heads 35, and their associated drying facilities 36 can all be easily adapted to packages 2 of different shapes, sizes, and kinds.

Another advantage of the apparatus described herein is that the printing segments 11, 11*a* are fully functional assembly units or modules. This both simplifies assembly of the apparatus 1 itself and promotes interchangeability of parts. As a result, it is easy to pull defective printing segments 11, 11*a* off the apparatus 1, repair them while they are off the apparatus 1, and reinstall them when repaired. This reduces down time for the apparatus 1 as a whole.

Another advantage of the apparatus described herein is that it becomes much easier for the manufacturer of the apparatus 1 to stock replacement parts.

Another advantage of the apparatus described herein is that, by using dummy segments 50 and 51, it is possible to easily reduce the performance, or throughput, of the apparatus 1.

Another advantage of the apparatus described herein is that identically constructed base units 5 can be used to construct the apparatus 1.

Another advantage of the apparatus described herein is that the apparatus 1 overall can be implemented as a compact design.

The invention was described above using selected examples. It is understood that numerous changes and modifications are possible, in particular also regarding the holding-and-centering units 16, the printing segments 11 and 11*a* and the apparatus 1 overall, without departing from the inventive idea underlying the invention. Thus, for example, instead of the coding 23 at the primary part 19 or in addition to this coding, another coding can also be provided at the secondary part 20 which then, together with an incremental sensor arranged at the printing segment 11 or 11*a*, forms an encoder system for the alignment and/or controlled rotation of the package 2.

Above, the invention was further discussed in connection with package 2 in the form of bottles. The apparatus according to the invention, their holding-and-centering units, and printing segments, however, are also suitable for applying a design to and/or to print on other containers or packages.

In particular, there is the possibility of designing the holding-and-centering units 16 or 16*a* such that these units tightly close the packages 2 not only during treatment and/or during sterilization and/or during rinsing but also, in particular, before and/or after completing the treatment and/or the sterilization and/or the rinsing and/or when passing the holding-and-centering units 16 or 16*a* with the respective single packages 2 from a treatment module 4.1-4.8 to the treatment module which follows in the transport direction A.

In a further advantageous design of the invention, the sterilizing medium remains, after rinsing and/or sterilizing, in the packages 2, or these are rinsed with an inert or sterile gas. At the end of the treatment of the packages 2, before they reach the package outlet 1.2, the medium is at least vacuumed out of the head-space of the packages 2. This is carried out by connecting the connecting element 34 or 65.1, via a device-internal fluid connection, to a negative pressure source, such as a suction pump.

Having described the invention, and a preferred embodiment thereof, what is claimed as new, and secured by Letters Patent is:

1. A method for treating packages, said method comprising using an apparatus that comprises a package inlet, a package outlet, a package transport path extending between said package inlet and said package outlet so that packages move along said package transport path along a transport direction from said package inlet to said package outlet, said package transport path being formed at least in part by a transport-and-treatment element having treatment positions, said transport-and-treatment element being drivable to rotate, wherein each of said treatment positions is configured to at least one of hold a package during treatment thereof, center said package during treatment thereof, and cause controlled movement of said package during treatment thereof, said apparatus further comprising holding-and-centering units, wherein each holding-and-centering unit comprises a puck configured to pick up a package at said package inlet and transport said package to said package outlet, wherein said puck releases said package only at said package outlet, and wherein said puck is configured to introduce a gaseous sterilizing agent into said package, arranging packages on treatment positions, applying designs to said packages, wherein applying designs comprises printing on said packages, wherein printing comprises inkjet printing, wherein printing on said packages takes place at treatment positions that are associated with said packages during printing thereon, and intermittently charging said packages, during printing thereon, with said gaseous sterilizing agent.

2. The method of claim 1, wherein intermittently charging comprises intermittently charging with a pressurized gaseous sterilizing agent.

3. The method of claim 1, wherein intermittently charging comprises exposure to a sterilizing agent comprising one of $H_2O_2$ and ozone, and exposure to a gaseous activating and drying component.

4. The method of claim 1, wherein treating said packages takes place in an environment, wherein said method further comprises, after said intermittently charging, closing said packages at least towards said environment at least during a part of a total duration of treatment of said packages.

5. The method of claim 1, further comprising holding said packages in corresponding holding-and-centering units, and wherein said intermittently charging takes place via said holding-and-centering units.

6. The method of claim 5, wherein holding comprises holding a first package in a first holding-and-centering unit throughout treatment thereof and holding a second package in a second holding-and-centering unit throughout treatment thereof, said method further comprising moving said first holding-and-centering unit in a transport direction of said transport path to a first treatment position, moving said second holding-and-centering unit in said transport direction of said transport path to a second treatment position, wherein said first treatment position and said second treatment position are consecutive treatment positions, at said first treatment position, charging said first package with said sterilizing agent, and, at said second treatment position, charging said second package with said sterilizing agent, wherein charging said first package and charging said second package occur simultaneously.

7. The method of claim 5, wherein holding comprises holding a first package in a first holding-and-centering unit throughout treatment thereof, said method further comprising moving said first package past at least two consecutive treatment positions in a transport direction of said transport path and causing said first holding-and-centering unit to hold said first package in a closed position during transfer thereof, by said first holding-and-centering element, from a transport-and-treatment element to a transport element that follows in said transport direction.

8. The method of claim 1, further comprising, upon completion of package treatment, sucking said sterilizing agent at least from a head-space of said package.

9. An apparatus that has been specifically designed to carry out a method that comprises applying designs to said packages, wherein applying designs comprises printing on said packages, wherein printing comprises inkjet printing, wherein said method further comprises arranging packages on treatment positions of a package transport path, and intermittently charging said packages, during printing thereon, with a gaseous sterilizing agent, said apparatus comprising a package inlet, a package outlet, said package transport path, a transport-and-treatment element, and said treatment positions, wherein said package transport path extends between said package inlet and said package outlet so that packages move along said package transport path along a transport direction from said package inlet to said package outlet, wherein said package transport path is formed at least in part by said at least one transport-and-treatment element, wherein said at least one transport-and-treatment element is drivable to rotate, wherein each of said treatment positions is configured to at least one of hold a package during treatment thereof, center a package during treatment thereof, and cause controlled movement of a package during treatment thereof, wherein printing of said design on a package takes place at a treatment position associated with said package, and wherein each of said treatment positions is further configured to charge a package associated with said treatment position with a sterilizing medium, further comprising holding-and-centering units, wherein each holding-and-centering unit comprises a puck, wherein said puck is configured to pick up a package at said package inlet and transport said package to said package outlet, wherein said puck releases said package only at said package outlet, and wherein said puck is configured to introduce said sterilizing agent.

10. The apparatus of claim 9, wherein each of said holding-and-centering units comprises a first gas path for introducing said sterilizing agent into a package, a second gas path for discharging said sterilizing agent from said package, and a connecting element via which said gas paths are connected to device-internal fluid connections for supplying and removing said sterilizing agent.

11. The apparatus of claim 9, wherein each of said holding-and-centering units is configured for closing off an interior of a package associated with said holding-and-centering unit.

12. The apparatus of claim 9, further comprising a puck transport path via which said pucks are returned from said package outlet to said package inlet, and at least one of a facility and a station disposed on said puck transport path, wherein said at least one of a facility and a station is selected from the group consisting of a cleaner for cleaning holding-and-centering units and a sterilizer for sterilizing holding-and-centering units.

13. The apparatus of claim 9, wherein said holding-and-centering units each comprise a mouth opening against which a package mouth of a package being treated abuts during treatment thereof, said apparatus further comprising rinsing caps for closing said openings during CIP cleaning and sterilization of said holding-and-centering units.

14. The apparatus of claim 9, wherein each holding-and-centering unit comprises a primary part and a secondary part, wherein said primary part is held, during treatment, at a treatment position, wherein said secondary part is configured to hold a package, and wherein, at or in said primary part, said secondary part is supported to be rotatable about an axis of said holding-and-centering unit.

15. The apparatus of claim 9, further comprising, at each treatment position, a printing segment comprising a print head for printing on a package, wherein each printing segment forms a fully functional assembly unit, and wherein said printing segments are arranged at a rotor that can be driven to rotate about a machine axis.

16. The apparatus of claim 15, wherein said print head is an inkjet print head, wherein each treatment position further comprises a facility for at least one of drying and curing printing ink by at least one of heat, UV radiation, and microwave radiation.

17. The apparatus of claim 15, wherein said apparatus defines a vertical machine axis about which said transport-and-treatment element is driven to rotate, and wherein said print heads are configured to be one of movable along said machine axis and pivotable about said machine axis.

18. The apparatus of claim 15, further comprising, at each treatment position, a printing-ink control module configured to at least one of control and regulate at least one of temperature of ink supplied to said print head and volume rate of flow of ink supplied to said print head, a pressure compensation tank for use in supplying ink to said print head under control of said printing-ink control module, and a pump for use in supplying ink to said print head under control of said printing-ink control module and discharging excess ink from said print head.

19. The apparatus of claim 15, wherein each holding-and-centering unit comprises at least one connection for at least one of supplying and discharging said sterilizing agent.

* * * * *